US009941070B2

(12) United States Patent
Liu

(10) Patent No.: US 9,941,070 B2
(45) Date of Patent: Apr. 10, 2018

(54) KEYSWITCH STRUCTURE MOUNTED WITHIN A CIRCUIT BOARD AND BASEPLATE

(71) Applicants: DARFON ELECTRONICS (SUZHOU) CO., LTD., Suzhou (CN); DARFON ELECTRONICS CORP., Taoyuan (TW)

(72) Inventor: Chia-Hung Liu, Taoyuan (TW)

(73) Assignees: DARFON ELECTRONICS (SUZHOU) CO., LTD., Suzhou (CN); DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 15/465,256

(22) Filed: Mar. 21, 2017

(65) Prior Publication Data

US 2017/0278649 A1 Sep. 28, 2017

(30) Foreign Application Priority Data

Mar. 25, 2016 (TW) ..... 105109571 A
Mar. 25, 2016 (TW) ..... 105204247 U

(51) Int. Cl.
*H01H 13/14* (2006.01)
*H01H 13/02* (2006.01)

(52) U.S. Cl.
CPC ..... *H01H 13/14* (2013.01); *H01H 13/023* (2013.01); *H01H 2215/00* (2013.01)

(58) Field of Classification Search
CPC ..... H01H 13/70; H01H 13/023; H01H 2223/054; G06F 3/0202
USPC ..... 200/310, 313, 314; 345/170; 362/23.03
See application file for complete search history.

(56) References Cited

U.S. PATENT DOCUMENTS 3,678,424 A * 7/1972 Iwashima ..... H01H 13/70 200/345
4,874,913 A * 10/1989 Aoki ..... H01H 13/023 200/314
7,507,924 B2 * 3/2009 Lorenzo Riera ..... H01H 13/023 200/314
7,538,285 B2 * 5/2009 Patel ..... H01H 13/705 200/314
8,878,085 B2 * 11/2014 Lin ..... G06F 3/0202 200/292

(Continued)

FOREIGN PATENT DOCUMENTS

CN 201196923 2/2009
CN 202678169 U 1/2013

(Continued)

OTHER PUBLICATIONS

Keymodule, Cherry Corporation (MX1A-11NW) Switch, 2002, 5 pages.

*Primary Examiner* — Vanessa Girardi
(74) *Attorney, Agent, or Firm* — Innovation Capital Law Group, LLP; Vic Lin

(57) ABSTRACT

A keyswitch structure includes a baseplate having a switch opening, a keycap movably disposed above the baseplate, a circuit board disposed on the baseplate, the circuit board having a through hole, and a mechanical switch disposed below the keycap, the mechanical switch extending through the through hole to be partially received in the switch opening and electrically coupled to the circuit board, wherein when the keycap moves toward the baseplate, the keycap triggers the mechanical switch.

20 Claims, 9 Drawing Sheets

(56) References Cited

U.S. PATENT DOCUMENTS

| | | | | |
|---|---|---|---|---|
| 9,640,346 | B2 * | 5/2017 | Cai | H01H 13/79 |
| 2007/0193867 | A1 * | 8/2007 | Lorenzo Riera | H01H 13/023 200/314 |
| 2013/0140165 | A1 * | 6/2013 | Lin | G06F 3/0202 200/5 A |
| 2013/0220786 | A1 | 8/2013 | Niu | |
| 2016/0322180 | A1 | 11/2016 | Jhuang et al. | |
| 2017/0076882 | A1 * | 3/2017 | Cai | H01H 13/79 |
| 2017/0264294 | A1 * | 9/2017 | Li | H03K 17/969 |

FOREIGN PATENT DOCUMENTS

| | | | |
|---|---|---|---|
| CN | 104715952 | A | 6/2015 |
| CN | 204614712 | U | 9/2015 |
| CN | 105070567 | A | 11/2015 |
| CN | 204834440 | U | 12/2015 |
| CN | 205621612 | U | 10/2016 |
| TW | M517901 | U | 2/2016 |
| TW | M529256 | U | 9/2016 |

* cited by examiner

KEYSWITCH STRUCTURE MOUNTED WITHIN A CIRCUIT BOARD AND BASEPLATE

BACKGROUND OF THE INVENTION

1. Field of the Invention

The invention generally relates to a keyswitch structure. Particularly, the invention relates to a keyswitch structure capable of promoting tactile feedback and effectively reducing key height.

2. Description of the Prior Art

Conventional keyboards usually use membrane switches as signal-generating elements. In general, the membrane switch consists of an upper circuit layer, a lower circuit layer, and a spacer between the upper circuit layer and the lower circuit layer. The upper circuit layer and the lower circuit layer have corresponding switch contacts as a trigger circuit of the keyswitch. When the keycap is pressed to trigger the membrane switch, the upper circuit layer is deformed, so the switch contact on the upper circuit layer contacts the corresponding switch contact on the lower circuit layer, and the membrane switch is conducted to generate a trigger signal. However, the membrane switch is readily damaged due to frequent operation or application of improper force and is difficult to be repaired. Moreover, when one of the trigger circuits in the membrane switch corresponding to a certain keyswitch is broken, the entire membrane switch of a keyboard have to be replaced, resulting in high maintenance cost.

In addition, when the user presses the keycap to trigger the membrane switch, the tactile feedback is reduced since the click of keystroke is not clear, resulting in unsatisfied manipulation for gamers.

Therefore, how to reinforce the tactile feedback and effectively reduce the key height is one of the important issues.

SUMMARY OF THE INVENTION

In view of the prior arts, it is an object of the present invention to provide a keyswitch structure, which utilizes a mechanical switch to enhance the tactile feedback and to promote the repairability of individual key.

It is another object of the invention to provide a keyswitch structure, which integrates the light-emitting unit and/or the electronic component on the circuit board to optimize the layout of keys.

It is a further object of the invention to provide a keyswitch structure, which has the baseplate designed with an opening for accommodating parts of the key to effectively reduce the key height.

In an embodiment, the keyswitch structure of the invention includes a baseplate having a switch opening, a keycap movably disposed above the baseplate, a circuit board having a through hole disposed on the baseplate, and a mechanical switch disposed below the keycap, wherein the mechanical switch extends through the through hole to be partially received in the switch opening and electrically coupled to the circuit board, and wherein when the keycap moves toward the baseplate, the keycap triggers the mechanical switch.

In an embodiment, the keyswitch structure further includes an electronic component, wherein the baseplate further has a component hole. The electronic component is electrically coupled to the circuit board and protrudes from a bottom surface of the circuit board to be at least partially received in the component hole.

In an embodiment, the keyswitch structure further includes a light-emitting unit and an electronic component, wherein the circuit board has an upper wiring layer electrically coupled to the light-emitting unit and a lower wiring layer electrically coupled to the electronic component. The baseplate further has a component hole, and the electronic component protrudes from a bottom surface of the circuit board to be at least partially received in the component hole. The light-emitting unit is exposed on a top surface of the circuit board, so the light-emitting unit is capable of emitting light toward the keycap.

In an embodiment, the keyswitch structure further includes a supporting unit coupling with the keycap and the baseplate to support the keycap moving relative to the baseplate, wherein the baseplate has at least one coupling member, and the circuit board has at least one opening corresponding to the at least one coupling member, so the coupling member extends upward through the opening to couple with the supporting unit.

In an embodiment, the circuit board is a rigid circuit board. When the keycap moves toward the baseplate to trigger the mechanical switch in response to a pressing force, the rigid circuit board is capable of sustaining the pressing force transferred by the mechanical switch without deforming downward.

In an embodiment, the mechanical switch has a lower section housing, a midsection housing, and a pin. The midsection housing and the lower section housing have different horizontal cross-sections. The pin extends substantially horizontally from the midsection housing to form a horizontally-extended portion and then is bent downward to be electrically coupled to the circuit board.

In an embodiment, the circuit board further includes a pin hole. The pin hole is not communicated with the through hole and positioned corresponding to the pin. When the lower section housing is positioned within the through hole, the pin extends into the pin hole.

In an embodiment, the switch opening is larger than the through hole, so the pin is received in the switch opening and a lower end of the pin maintains a predetermined distance from the baseplate after the pin is bent downward to penetrate the circuit board.

In an embodiment, the shape of the through hole is substantially matching the horizontal cross-section of the lower section housing, so the lower section housing is fitted into the through hole and substantially contacts an inner wall of the through hole to make the mechanical switch be firmly received by the through hole.

In an embodiment, the horizontal cross-section of the midsection housing is not matching the shape of the through hole, so the midsection housing is unable to enter the through hole, and the horizontally-extended portion is positioned above the circuit board.

In another embodiment, the keyswitch structure of the invention includes a baseplate, a circuit board disposed on the baseplate, a keycap disposed above the circuit board and maintaining a distance from the baseplate, a supporting unit disposed between the baseplate and the keycap, the supporting unit coupling with the keycap and the baseplate to support the keycap to move relative to the baseplate, and a mechanical switch disposed below the keycap. The mechanical switch is surrounded by the supporting unit and has a housing and a plurality of pins. The mechanical switch is electrically coupled to the circuit board by the plurality of pins, and a portion of the housing abuts a top surface of the circuit board. When the keycap moves toward the baseplate in response to a pressing force, the keycap triggers the mechanical switch, and when the pressing force is removed, the mechanical switch drives the keycap to move upward away from the baseplate.

In a further embodiment, the keyswitch structure of the invention includes a baseplate having a component hole, a keycap movably disposed above the baseplate, a circuit board disposed on the baseplate, a mechanical switch disposed below the keycap, the mechanical switch having a housing and a plurality of pins, the mechanical switch electrically coupled to the circuit board by the plurality of pins, and a portion of the housing abutting a top surface of the circuit board, and an electronic component electrically coupled to the circuit board and protruding from a bottom surface of the circuit board to be at least partially received in the component hole.

In an embodiment, the circuit board further includes a through hole and a pin hole. The pin hole is not communicated with the through hole and positioned corresponding to the pin. When the lower section housing is positioned within the through hole, the pin extends into the pin hole.

DETAILED DESCRIPTION OF THE PREFERRED EMBODIMENT

Figure 1A:
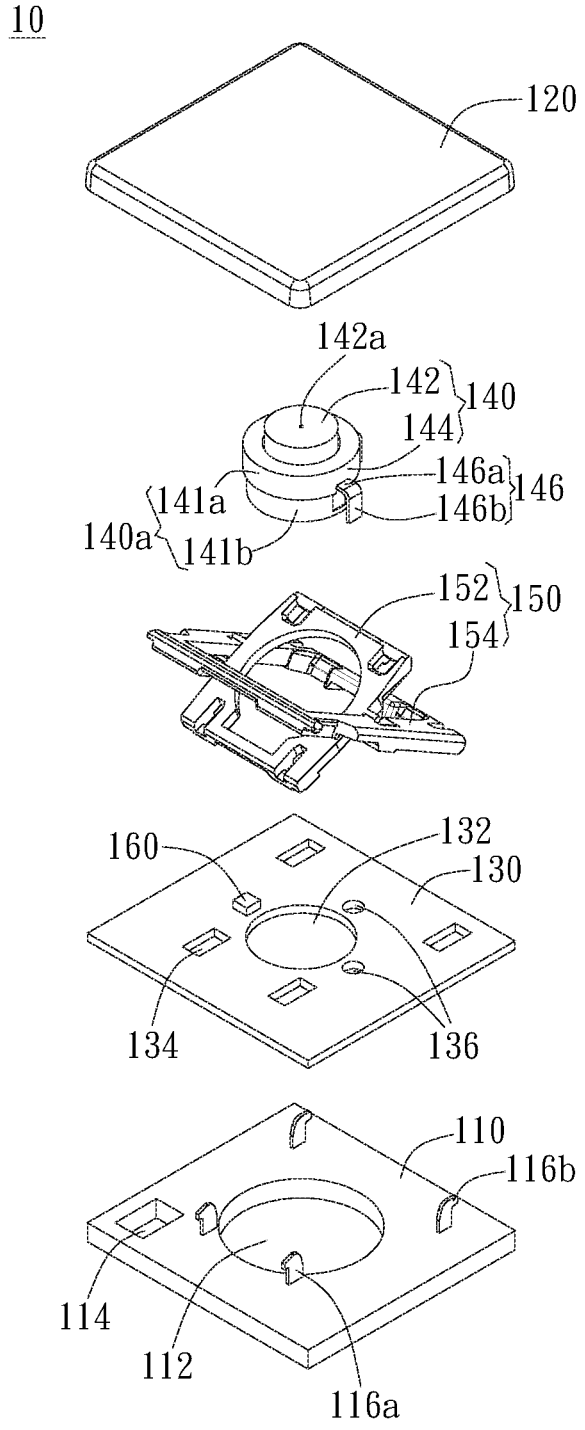
FIGS. 1A and 1B are exploded views of an embodiment of the keyswitch structure of the invention from different viewing angles.

The invention provides a keyswitch structure, which can be applied to any pressing type input device including keyboard to enhance the tactile feedback, effectively reduce the key height, or promote the repairability of individual key. Hereafter, the keyswitch structure of the invention will be described in detail with reference to the drawings.

As shown in FIGS. 1A to 1D, in an embodiment, the keyswitch structure 10 includes a baseplate 110, a keycap 120, a circuit board 130, and a mechanical switch 140. The baseplate 110 has a switch opening 112. The keycap 120 is movably disposed above the baseplate 110. The circuit board 130 is disposed on the baseplate 110 and has a through hole 132 and at least one pin hole 136. The mechanical switch 140 is disposed below the keycap 110 and extends through the through hole 132 to be at least partially received in the switch opening 112. The mechanical switch 140 is electrically coupled to the circuit board 130. When the keycap 120 moves toward the baseplate 110, the keycap 120 triggers the mechanical switch 140. The keyswitch structure 10 may further include a supporting unit 150 for supporting the keycap 120 moving relative to the baseplate 110, a light-emitting unit 160 for emitting light toward the keycap 120, and/or an electronic component 170 (described later). It is noted that although in this embodiment only one keyswitch structure 10 is illustrated for explanation, as a keyboard usually comprises a plurality of keyswitch structures 10, some elements of the keyswitch structures 10 can be integrated into a single component, (e.g. one piece of broader baseplate 110 or circuit board 130 extending within the plurality of keyswitch structures 10), in order to lower the manufacturing cost and to benefit the assembly cost.

The baseplate 110 has the switch opening 112 and a component hole 114 for accommodating the mechanical switch 140 and the electronic component 170, respectively. In this embodiment, the switch opening 112 and the component hole 114 are preferably holes that extend through the baseplate 110 to create a maximum accommodation space along the thickness direction of the baseplate 110 (i.e. along the moving direction of the keycap 120), but not limited thereto. In another embodiment, the switch opening 112 and the component hole 114 can be concave portions that recessed from the top surface of the baseplate 110 and extend away from the keycap 120 (i.e. extends downward). That is, the switch opening 112 and the component hole 114 can be blind holes formed on the baseplate 110. The mechanical switch 140 has a housing 140*a* and at least one pin 146. Specifically, the housing 140*a* includes a midsection housing 141*a* and a lower section housing 141*b*. In an embodiment, the midsection housing 141*a* and the lower section housing 141*b* have different horizontal cross-sections. For example, the housing 140*a* has a wider midsection housing 141*a* and a narrower lower section housing 141*b*. The at least one pin 146 extends horizontally from a middle portion of the housing 140*a* and then is bent downward to connect the circuit board 130. Specifically, the at least one pin 146 extends substantially horizontally from the midsection housing 141*a* to form a horizontally-extended portion 146*a* and then is bent downward to form a substantial vertical extended portion 146*b*, which is electrically coupled to the circuit board 130. The switch opening 112 and the component hole 114 are preferably designed to have a size and a shape capable of accommodating the mechanical switch 140 (including the pin 146) and the electronic component 170, respectively. When the mechanical switch 140 and the electronic component 170 are respectively received in the switch opening 112 and the component hole 114, the inner walls of the switch opening 112 and the component hole 114 preferably maintain appropriate distance away from the pin 146 of the mechanical switch 140 and the electronic component 170, respectively. As such, when the baseplate 110 is made of metal material, short circuit caused by spark discharge between the pin 146 and the baseplate 110 or between the electronic component 170 and the baseplate 110 can be avoided.

The baseplate 110 includes at least one coupling member (e.g. 116*a*, 116*b*) for coupling the supporting unit 150. In this embodiment, a plurality of hook-like members protrude toward the keycap 120 (i.e. upward) from the upper surface of the baseplate 110 to function as the coupling members 116*a*, 116*b* for coupling the supporting unit 150, but not limited thereto. In another embodiment, the coupling members 116*a*, 116*b* can have different configurations according to the structure of the supporting unit 150. The baseplate 110 can be an integral structure having the switch opening 112, the component hole 114, and the coupling members 116*a*, 116*b* formed by mechanical-processing a metal plate or by plastic molding. In another embodiment, the coupling members 116*a*, 116*b* can be attached to the baseplate 110 by adhering, welding, or engaging.

The supporting unit 150 is disposed between the keycap 120 and the baseplate 110 and couples with the keycap 120 and the baseplate 110 to support the keycap 120 moving relative to the baseplate 110. In this embodiment, the supporting unit 150 includes a first frame 152 and a second frame 154. The first frame 152 is rotatably connected to the second frame 154 to form a scissors-like structure. Specifically, two ends of the first frame 152 are rotatably connected to the engaging portion 122*a* of the keycap 120 and movably connected to the coupling member 116*a* of the baseplate 110, respectively. Two ends of the second frame 154 are movably connected to the engaging portion 122*b* of the keycap 120 and rotatably connected to the coupling member 116*b* of the baseplate 110, respectively. As shown in FIG. 1C, on the right hand side of the scissors-like supporting unit 150, the first frame 152 and the second frame 154 are connected to the keycap 120 and the baseplate 110, respectively. In contrast, on the left hand side of the scissors-like supporting unit 150, the first frame 152 and the second frame 154 are connected to the baseplate 110 and the keycap 120, respectively.

The circuit board 130 is preferably a circuit board with desired circuit layout, to which the mechanical switch 140 is electrically coupled. The circuit board 130 can be mechanically processed to form the through hole 132 and the pin holes 136, which does not communicate with the through hole 132. That is, the through hole 132 and the pin holes 136 are separate holes. When the circuit board 130 is disposed on the baseplate 110, the through hole 132 is aligned and communicates with the switch opening 112 of the baseplate 110. The size and shape of the through hole 132 preferably correspond to the size and shape of the housing 140*a* of the mechanical switch 140, and the size and shape of the pin hole 136 preferably correspond to those of the pin 146 of the mechanical switch 140. Specifically, the size and the shape of the through hole 132 is substantially matching the horizontal cross-section of the lower section housing 141*b*, so the lower section housing 141*b* of the mechanical switch 140 can be fitted into the through hole 132, and a portion of the pin 146 extends into the pin hole 136. In such a configuration, a portion of the housing 140*a* (i.e. the lower section housing 141*b*) and a portion of the pin 146 (i.e. the vertical extended portion 146*b*) protrude out the lower surface of the circuit board 130 to be received in the switch opening 112 of the baseplate 110. Moreover, the diameter of the through hole 132 is substantially equal to the outer diameter of the lower section housing 141*b* of the housing 140*a* of the mechanical switch 140, so when the lower portion of the mechanical switch 140 is fitted into the through hole 132, the lower section housing 141*b* of the mechanical switch 140 substantially contacts an inner wall of the through hole 132 to enhance the positioning of the mechanical switch 140, which is firmly received by the through hole 132. In such a configuration, the horizontal cross-section of the midsection housing 141*a* is not matching the shape of the through hole 132 (i.e. the cross-section of the midsection housing 141*a* is larger than that of the lower section housing 141*b*), so the midsection housing 141*a* is unable to enter the through hole 132 and preferably abuts the top surface of the circuit board 130, and the horizontally-extended portion 146*a* is positioned above the circuit board 130 while the vertical extended portion 146*b*is electrically coupled to the circuit board 130 and extends into the pin hole 136. In another embodiment, the through hole 132 can be slightly larger than the mechanical switch 140, so when the mechanical switch 140 extends through the through hole 132 of the circuit board 130 to be partially received in the switch opening 112 of the baseplate 110, there is a small gap between the housing 140*a* of the mechanical switch 140 and the inner wall of the through hole 132. In such a case, the switch opening 112 of the baseplate 110 preferably has a cross-section matching the cross-section of the mechanical switch 140, so the mechanical switch 140 can be firmly received by the switch opening 112 to enhance the support of the mechanical switch 140. Alternatively, when the switch opening 112 is a concave portion, the bottom of the concave portion can support the mechanical switch 140, and the switch opening 112 need not to have a cross-section matching the cross-section of the mechanical switch 140.

Figure 1B:
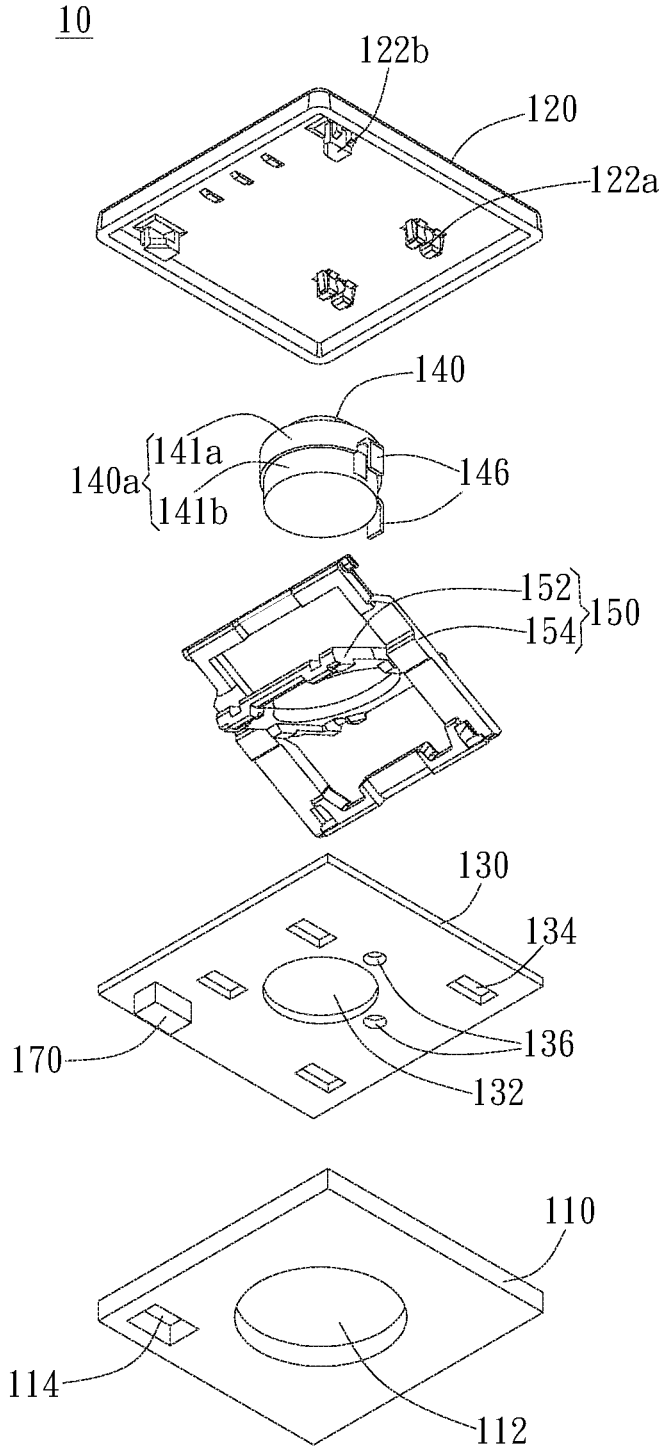
Figure 1C:
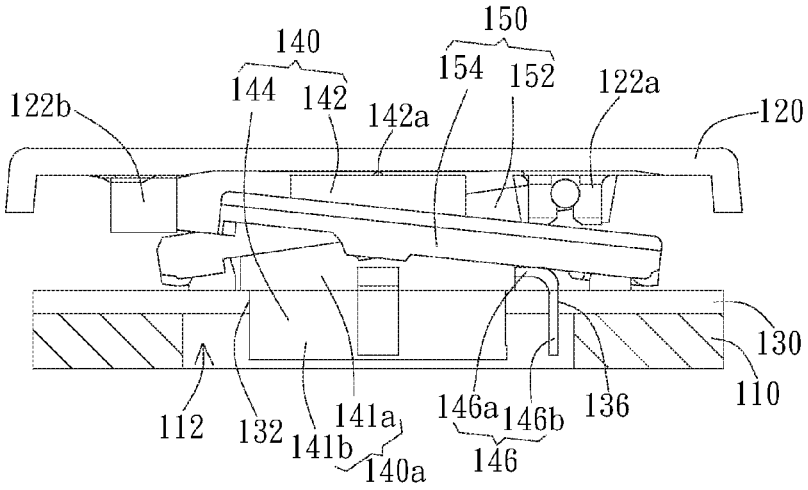
FIGS. 1C and 1D are cross-sectional views of FIG. 1A from different directions.
Figure 1D:
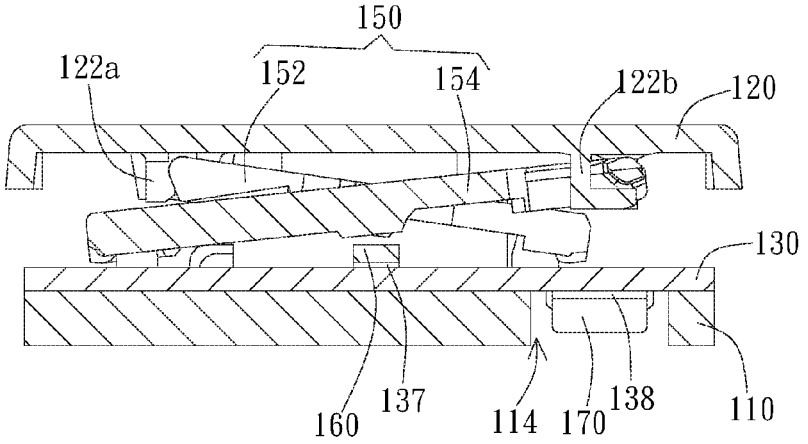

In this embodiment, as shown in FIG. 1D, the circuit board 130 has an upper wiring layer 137 and a lower wiring layer 138 on its top and bottom surfaces, respectively. The upper wiring layer 137 is electrically coupled to the light-emitting unit 160, and the lower wiring layer 138 is electrically coupled to the electronic component 170. As such, the circuit board 130 not only provides the signal conduction path to the mechanical switch 140, but also provides electrical paths for driving the light-emitting unit 160 and the electronic component 170. Specifically, as shown in FIG. 1D, the light emitting-unit 160 and the electronic component 170 are preferably disposed on the top surface and the bottom surface of the circuit board 130, respectively. The light-emitting unit 160 is electrically coupled to the upper wiring layer 137 of the circuit board 130 and is exposed on the top surface of the circuit board 130. The light-emitting unit 160 is preferably located within the vertical projection range of the first frame 152 (i.e. inner frame) and is neighboring to the through hole 132, so the light emitted from the light-emitting unit 160 can be more uniformly emitted toward the bottom surface of the keycap 120 to make the keyswitch structure 10 become a backlit key. In this embodiment, the light-emitting unit 160 can be embodied as a light-emitting diode emitting the light from the top surface. The electronic component 170 is electrically coupled to the lower wiring layer 138 of the circuit board 130 and protrudes from the bottom surface of the circuit board 130 to be at least partially received in the component hole 114 of the baseplate 110. As such, the space required for accommodating the electronic component 170 can be effectively reduced or even eliminated, and the total height of the keyswitch structure 10 is accordingly decreased. In this embodiment, the electronic component 170 can be any suitable electronic component for operation of the keyswitch structure 10 or the keyboard device. The electronic component 170 can be, for example but not limited to, microcontroller, resistor, capacitor, inductor, and the like.

Moreover, as shown in FIGS. 1A and 1B, the circuit board 130 has at least one opening 134 corresponding to the at least one coupling member 116*a*, 116*b*, so the coupling member 116*a*, 116*b* extends upward through the opening 134 to couple with the supporting unit 150. In this embodiment, the circuit board 130 is preferably a rigid circuit board. When the keycap 120 moves toward the baseplate 10 to trigger the mechanical switch 140 in response to a pressing force, the rigid circuit board 130 is capable of sustaining the pressing force transferred by the mechanical switch 140 without substantially deforming downward. As such, the chance of damage caused by deformation as occurred in the conventional membrane switch can be eliminated. In another embodiment, the circuit board 130 can be a flexible circuit board with necessary wiring layout of electrical paths.

The mechanical switch 140 can be any suitable mechanical switch consisting of spring and relatively movable contacts. The mechanical switch 140 includes a trigger portion 142 and a switch portion 144. Upon receiving the pressing force, the trigger portion 142 can move relative to the switch portion 144 to trigger the switch portion 144 generating a trigger signal. When the pressing force is removed, the trigger portion 142 can move relative to the switch portion 144 and return to its original position (i.e. non-trigger position). That is, when the trigger portion 142 moves upon receiving the pressing force, the spring is deformed to make the contacts relative move toward each other and contact each other to generate the triggering signal. When the pressing force is removed, the spring provides a restoring force to make the contacts relatively move away from each other and drive the trigger portion 142 to move back to its original position. Moreover, the mechanical switch 140 has the housing 140*a* of the switch portion 144 and at least one pin 146. The at least one pin 146 extends horizontally from the midsection housing 141*a* of the housing 140*a* and then is bent downward connect the circuit board 130, as described above. In this embodiment, after the at least one pin 146 is bent downward to penetrate the circuit board 130 and to be electrically coupled to the circuit board 130, the lower end of the pin 146 (i.e. the vertical extended portion 146*b*) is preferably received in the switch opening 112. That is, the switch opening 112 of the baseplate 110 is preferably larger than the through hole 132 of the circuit board 130, so not only the switch portion 144 of the mechanical switch 140 (e.g. the lower section housing 141*b*), but also a portion of the pin 146 that protrudes from the bottom surface of the circuit board 130 is received in the switch opening 112, and a lower end of the pin 146 (i.e. the vertical extended portion 146*b*) maintains a predetermined distance from baseplate 110. As such, when the baseplate 110 is made of metal, short circuit caused by spark discharge between the pin 146 and the baseplate 110 can be avoided. In another embodiment, additional insulation material or insulation glue can be disposed between the pin 146 and the baseplate 110 for electrical insulation. In another embodiment, instead of disposed within the same switch opening 112, the baseplate 110 can have additional holes (not shown) for accommodating the lower ends of the pins 146.

The trigger portion 142 preferably has a protrusion 142*a* on its top end. When the mechanical switch 140 is disposed below the keycap 120, the protrusion 142*a* is in contact with the bottom surface of the keycap 120. When the keycap 120 moves toward the baseplate 110 in response to the pressing force, the keycap 120 pushes the trigger portion 142 of the mechanical switch 140 and drives the trigger portion 142 to move downward and toward the switch portion 144, and the trigger signal is generated. When the pressing force is removed, the trigger portion 142 driven by the restoring force of the spring automatically moves upward away from the switch portion 144, and the keycap 120 which is supported by the supporting unit 150 and driven by the trigger portion 142 moves upward away from the baseplate 110 and returns to its original position.

Figure 2:
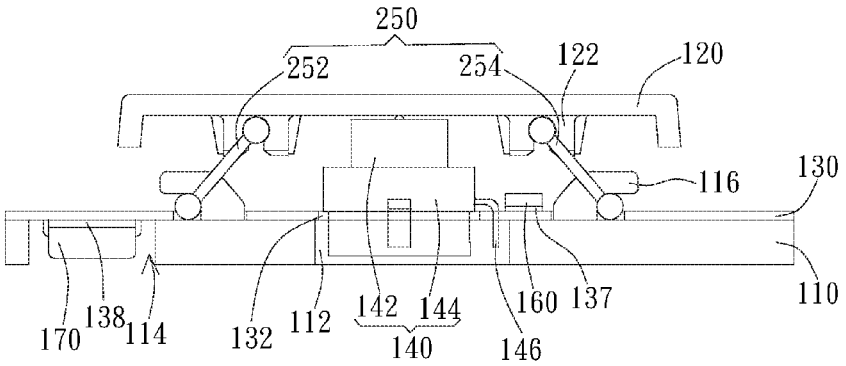
FIGS. 2 to 5 are schematic views of various embodiments of the keyswitch structure of the invention.
Figure 3:
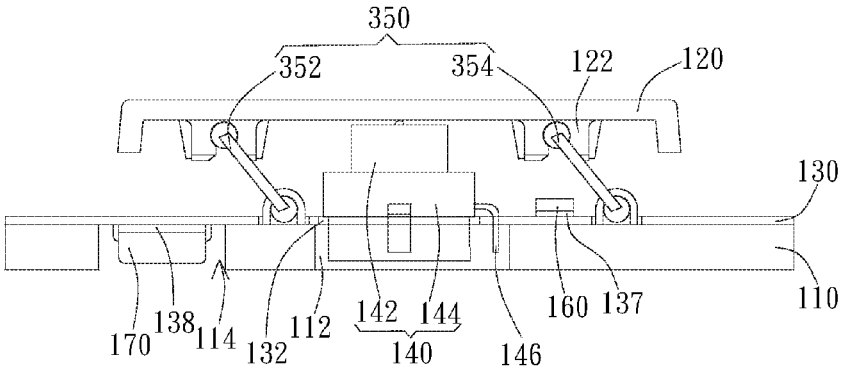

It is noted that the keyswitch structure of the invention may have different supporting units or coupling mechanisms to support the keycap 120 moving relative to the baseplate 110. In another embodiment, as shown in FIG. 2, the supporting unit 250 includes a first frame 252 and a second frame 254, wherein each of the first frame 252 and the second frame 254 is rotatably connected to the keycap 120 and movably connected to the baseplate 110 to support the keycap 120 moving relative to the baseplate 110. For example, the upper ends of the first frame 252 and the second frame 254 are rotatably connected to the engaging portions 122 of the keycap 120, and the lower ends of the first frame 252 and the second frame 254 are movably connected to the coupling members 116 of the baseplate 110. When the keycap 120 moves toward the baseplate 110, the first frame 252 and the second frame 254 slide away from each other on the baseplate 110 to support the keycap 120 stably moving downward. When the keycap 120 moves away from the baseplate 110, the first frame 252 and the second frame 254 slide toward each other on the baseplate 110 to support the keycap 120 stably moving upward. In a further embodiment, as shown in FIG. 3, the supporting unit 350 includes a first frame 352 and a second frame 354, wherein each of the first frame 352 and the second frame 354 are rotatably connected to the keycap 120 and the baseplate 110 to support the keycap 120 simultaneously horizontally and vertically moving relative to the baseplate 110. It is noted that the first frame 252 (or 352) and the second frame 254 (or 354) can be a frame-like linking structure, wherein the first frame 252 and the second frame 254 (or the first frame 352 and the second frame 354) preferably have an identical structure to reduce the manufacturing cost, but not limited thereto.

Figure 4:
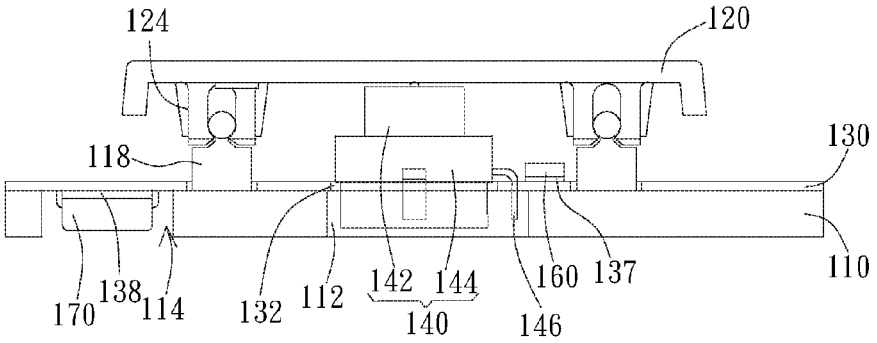
Figure 5:
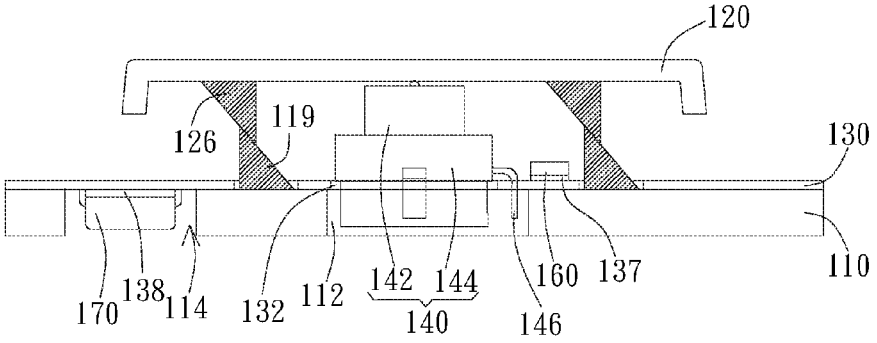
Figure 6A:
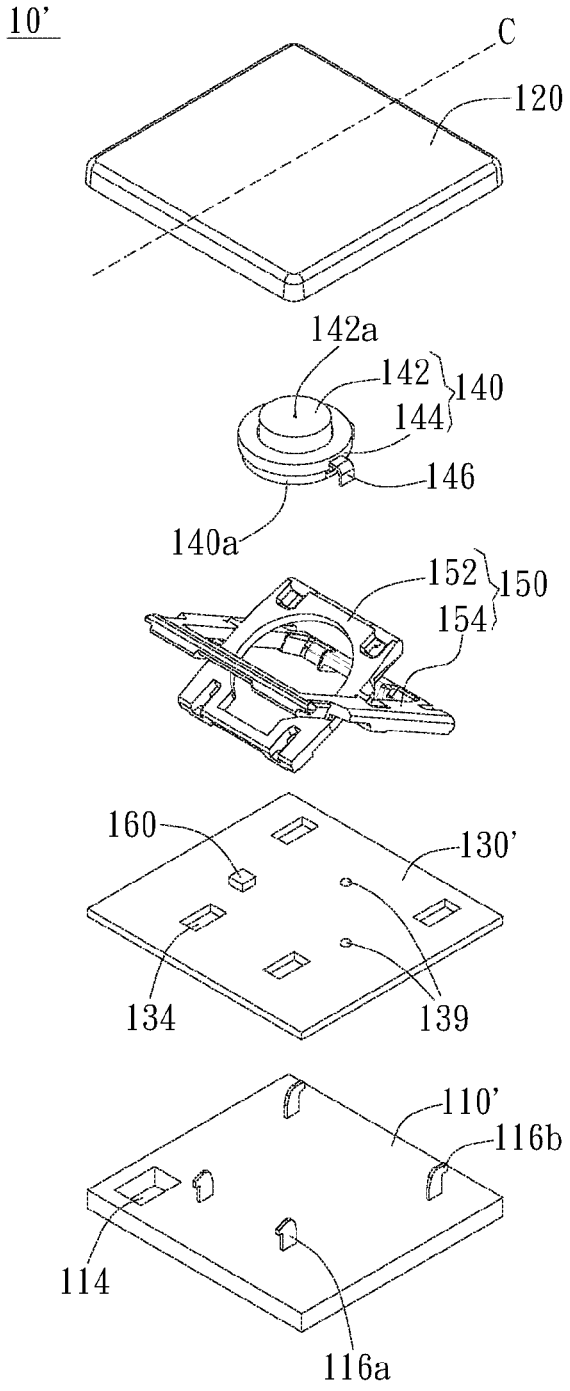
FIGS. 6A and 6B are exploded views of an embodiment of the keyswitch structure of the invention from different viewing angles.
Figure 6B:
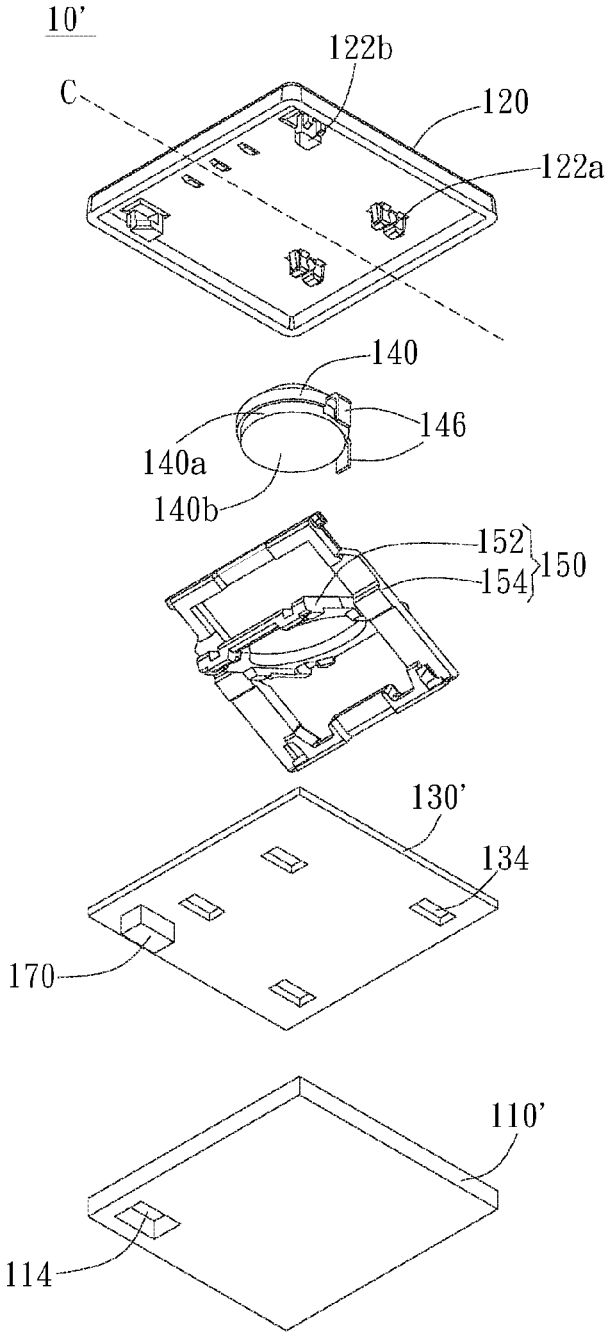
Figure 6C:
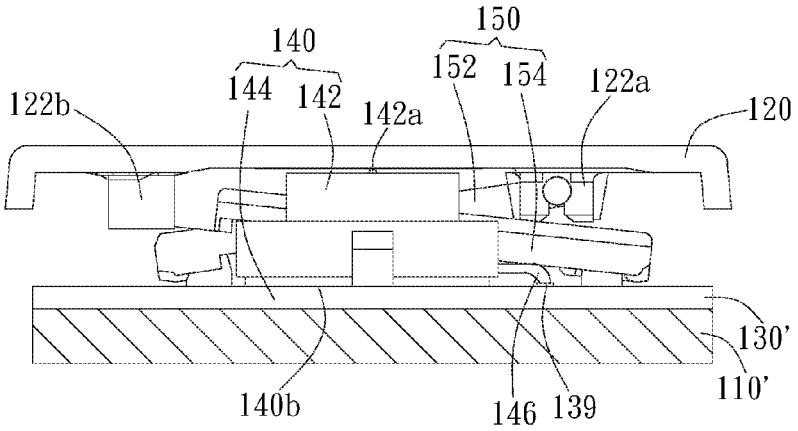
FIGS. 6C and 6D are cross-sectional views of FIG. 6A from different directions.
Figure 6D:
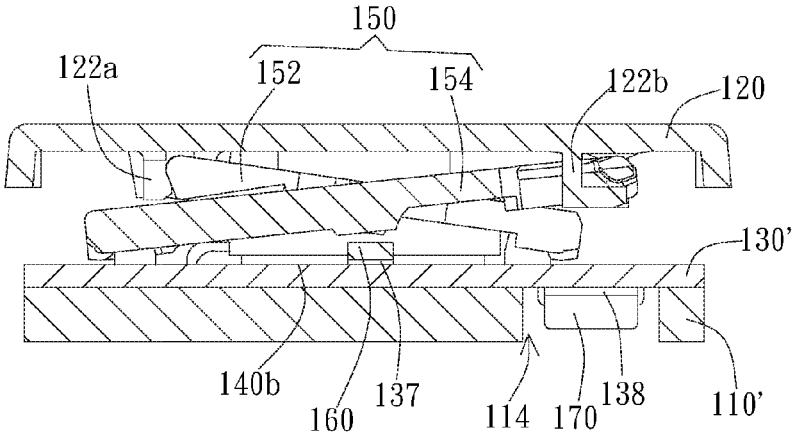

Moreover, the keycap 120 and baseplate 110 may have different coupling mechanisms to support the keycap 120 moving relative to the baseplate 110. In another embodiment, as shown in FIG. 4, a connection portion 124 with a groove is disposed on the bottom surface of the keycap 120, and a coupling portion 118 with a bump are disposed on the top surface of the baseplate 110. The bump is inserted into the groove, so the connection portion 124 is movably connected to the coupling portion 118. When the keycap 120 moves relative to the baseplate 110, the bump of the coupling portion 118 moves along the groove of the connection portion 124 to support the keycap 120 stably moving relative to the baseplate 110. In a further embodiment, as shown in FIG. 5, a first coupling portion 126 with a slanted surface is disposed on the bottom surface of the keycap 120, and a second coupling portion 119 with a corresponding slanted surface is disposed on the top surface of the baseplate 110. When the keycap 120 moves relative to the baseplate 110, the slanted surface of the first coupling portion 126 moves relative to the slanted surface of the second coupling surface 119, so the keycap 120 simultaneously has a horizontal displacement and a vertical displacement relative to the baseplate 110.

It is noted that in the embodiments of FIGS. 2-5, the arrangement and functions of other elements (e.g. the circuit board 130, the mechanical switch 140, the light-emitting unit 160, the electronic component 170) of the keyswitch structure are similar to those of the keyswitch structure 10, so the detailed descriptions of the structure and connection of these elements can refer to the related descriptions of FIGS. 1A-1D and will not elaborate again.

Moreover, in the above embodiments, the mechanical switch 140 is electrically coupled to the circuit board 130 by through hole soldering technique, but not limited thereto. In other embodiments, the mechanical switch can be electrically coupled to the circuit board by surface mount technique (SMT). As shown in FIGS. 6A to 6D, in another embodiment, the keyswitch structure 10' of the invention includes a baseplate 110', a keycap 120, a circuit board 130', a supporting unit 150, and a mechanical switch 140. The circuit board 130' is disposed on the baseplate 110'. The keycap 120 is disposed above the circuit board 130' and maintains a distance with the baseplate 110'. The keycap 120 has a keycap centerline C. The supporting unit 150 is disposed between the baseplate 110' and the keycap 120. The supporting unit 150 couples with the keycap 120 and the baseplate 110' to support the keycap 120 to move relative to the baseplate 110'. The supporting unit 150 preferably has a symmetric structure with respect to the keycap centerline C. The mechanical switch 140 is disposed below the keycap 120 and right under the keycap centerline C. The mechanical switch 140 is surrounded by the supporting unit 150 and has a housing 140*a* and a plurality of pins 146. The mechanical switch 140 is electrically coupled to the circuit board 130' by the plurality of pins 146, and a portion of the housing 140*a* abuts a top surface of the circuit board 130'. That is, when the mechanical switch 140 is electrically surface-mounted on the circuit board 130', the housing bottom surface 140*b* of the housing 140*a* of the mechanical switch 140 is at least partially physically in contact with the top surface of the circuit board 130'. When the keycap 120 moves toward the baseplate 110' in response to a pressing force, the keycap 120 triggers the mechanical switch 140. When the pressing force is removed, the mechanical switch 140 drives the keycap 120 to move upward away from the baseplate 110'.

It is noted that since the mechanical switch 140 is electrically coupled to the circuit board 130' by SMT, the baseplate 110' and the circuit board 130' may have different designs compared to the embodiment of FIG. 1. For example, the baseplate 110' may omit the switch opening 112 but only the component hole 114 for accommodating the electronic component 170. The circuit board 130' may omit the pin hole 136 but a solder portion 139 for electrically connecting the pin 146 by SMT. In this embodiment, the circuit board 130' may also omit the through hole 134 of FIG. 1. The arrangement and functions of other elements (e.g. the keycap 120, the supporting unit 150, the light-emitting unit 160, the electronic component 170) of the keyswitch structure 10' are similar to those of the keyswitch structure 10, so the detailed descriptions of the structure and connection of these elements can refer to the related descriptions of FIGS. 1A-1D.

Figure 7:
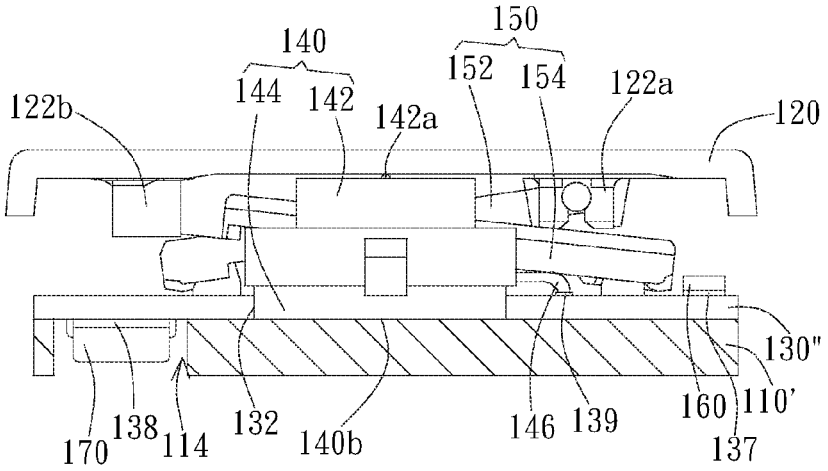
FIG. 7 is a schematic view of another embodiment of the keyswitch structure of the invention.

Moreover, corresponding to the design of mechanical switch, as shown in FIG. 7, the circuit board 130" may have the through hole 132 and the solder portion 139. When the mechanical switch 140 is surface-mounted on the circuit board 130", the housing bottom surface 140*b* is inserted into the through hole 132 to enhance the positioning of the mechanical switch 140.

It is noted that the surface mount technology may be applied to the embodiments of FIGS. 2 to 5 with different supporting mechanisms. Accordingly, the circuit board and the baseplate of FIGS. 2 to 5 may have configurations similar to those shown in FIG. 6A or 7, and will not elaborate again.

Compared to the prior arts, the keyswitch structure of the invention utilizes a mechanical switch to enhance the tactile feedback and integrates the mechanical switch on the circuit board to promote the repairability of individual key. Moreover, the keyswitch structure of the invention utilizes the thicknesses of the circuit board and the baseplate to form a space (e.g. through hole or switch opening) for accommodating the mechanical switch that effectively reduces the key height. In addition, the keyswitch structure integrates the electronic component under the circuit board and has the electronic component to be at least partially received in the component hole of the baseplate, further reducing the key height.

Although the preferred embodiments of the present invention have been described herein, the above description is merely illustrative. The preferred embodiments disclosed will not limit the scope of the present invention. Further modification of the invention herein disclosed will occur to those skilled in the respective arts and all such modifications are deemed to be within the scope of the invention as defined by the appended claims.

What is claimed is:

1. A keyswitch structure, comprising:

a baseplate having a switch opening;

a keycap movably disposed above the baseplate;

a circuit board disposed on the baseplate, the circuit board having a through hole; and a mechanical switch disposed below the keycap, the mechanical switch extending through the through hole to be partially received in the switch opening and electrically coupled to the circuit board, wherein when the keycap moves toward the baseplate, the keycap triggers the mechanical switch.

2. The keyswitch structure of claim 1, further comprising an electronic component, wherein the baseplate further has a component hole; the electronic component is electrically coupled to the circuit board and protrudes from a bottom surface of the circuit board to be at least partially received in the component hole.

3. The keyswitch structure of claim 1, further comprising an electronic component and a light-emitting unit, wherein the circuit board has an upper wiring layer electrically coupled to the light-emitting unit and a lower wiring layer electrically coupled to the electronic component; the baseplate further has a component hole; the electronic component protrudes from a bottom surface of the circuit board to be at least partially received in the component hole; the light-emitting unit is exposed on a top surface of the circuit board, so the light-emitting unit is capable of emitting light toward the keycap.

4. The keyswitch structure of claim 1, further comprising a supporting unit coupling with the keycap and the baseplate to support the keycap moving relative to the baseplate, wherein the baseplate has at least one coupling member and the circuit board has at least one opening corresponding to the at least one coupling member, so the coupling member extends upward through the opening to couple with the supporting unit.

5. The keyswitch structure of claim 1, wherein the circuit board is a rigid circuit board; when the keycap moves toward the baseplate to trigger the mechanical switch in response to a pressing force, the rigid circuit board is capable of sustaining the pressing force transferred by the mechanical switch without deforming downward.

6. The keyswitch structure of claim 1, wherein the mechanical switch has a lower section housing, a midsection housing, and a pin; the midsection housing and the lower section housing have different horizontal cross-sections; the pin extends substantially horizontally from the midsection housing to form a horizontally-extended portion and then is bent downward to be electrically coupled to the circuit board.

7. The keyswitch structure of claim 6, wherein the circuit board further comprises a pin hole; the pin hole is not communicated with the through hole and positioned corresponding to the pin; when the lower section housing is positioned within the through hole, the pin extends into the pin hole.

8. The keyswitch structure of claim 6, wherein the switch opening is larger than the through hole, so the pin is received in the switch opening and a lower end of the pin maintains a predetermined distance from the baseplate after the pin is bent downward to penetrate the circuit board.

9. The keyswitch structure of claim 6, wherein the shape of the through hole is substantially matching the horizontal cross-section of the lower section housing, so the lower section housing is fitted into the through hole and substantially contacts an inner wall of the through hole to make the mechanical switch be firmly received by the through hole.

10. The keyswitch structure of claim 6, wherein the horizontal cross-section of the midsection housing is not matching the shape of the through hole, so the midsection housing is unable to enter the through hole, and the horizontally-extended portion is positioned above the circuit board.

11. A keyswitch structure, comprising:

a baseplate;

a circuit board disposed on the baseplate;

a keycap disposed above the circuit board, the keycap maintaining a distance from the baseplate;

a supporting unit disposed between the baseplate and the keycap, the supporting unit coupling with the keycap and the baseplate to support the keycap to move relative to the baseplate; and a mechanical switch disposed below the keycap, the mechanical switch being surrounded by the supporting unit and having a housing and a plurality of pins, the mechanical switch electrically coupled to the circuit board by the plurality of pins, and a portion of the housing abutting a top surface of the circuit board, wherein when the keycap moves toward the baseplate in response to a pressing force, the keycap triggers the mechanical switch;

when the pressing force is removed, the mechanical switch drives the keycap to move upward away from the baseplate.

12. The keyswitch structure of claim 11, further comprising an electronic component, wherein the baseplate further has a component hole; the electronic component is electrically coupled to the circuit board and protrudes from a bottom surface of the circuit board to be at least partially received in the component hole.

13. The keyswitch structure of claim 11, wherein the housing of the mechanical switch includes a lower section housing and a midsection housing; the midsection housing and the lower section housing have different horizontal cross-sections; one of the plurality of pins extends substantially horizontally from the midsection housing to form a horizontally-extended portion, and then is bent downward to be electrically coupled to the circuit board.

14. The keyswitch structure of claim 13, wherein the circuit board further comprises a through hole and a pin hole; the pin hole is not communicated with the through hole and positioned corresponding to the one of the plurality of pins; when the lower section housing is positioned within the through hole, the one of the plurality of pins extends into the pin hole.

15. The keyswitch structure of claim 13, wherein the shape of the through hole is substantially matching the horizontal cross-section of the lower section housing, so the lower section housing is fitted into the through hole and substantially contacts an inner wall of the through hole, but the midsection housing is unable to enter the through hole and abuts the top surface of the circuit board, and the horizontally-extended portion is positioned above the circuit board.

16. A keyswitch structure, comprising:

a baseplate having a component hole;

a keycap movably disposed above the baseplate;

a circuit board disposed on the baseplate;

a mechanical switch disposed below the keycap, the mechanical switch having a housing and a plurality of pins, the mechanical switch electrically coupled to the circuit board by the plurality of pins, and a portion of the housing abutting a top surface of the circuit board; and an electronic component electrically coupled to the circuit board and protruding from a bottom surface of the circuit board to be at least partially received in the component hole.

17. The keyswitch structure of claim 16, further comprising a light-emitting unit, wherein the circuit board has an upper wiring layer electrically coupled to the light-emitting unit and a lower wiring layer electrically coupled to the electronic component; the light-emitting unit is exposed on the top surface of the circuit board, so the light-emitting unit is capable of emitting light toward the keycap.

18. The keyswitch structure of claim 16, wherein the housing of the mechanical switch includes a lower section housing and a midsection housing; the midsection housing and the lower section housing have different horizontal cross-sections; one of the plurality of pins extends substantially horizontally from the midsection housing to form a horizontally-extended portion, and then is bent downward to be electrically coupled to the circuit board.

19. The keyswitch structure of claim 18, wherein the circuit board further comprises a pin hole and a through hole; the pin hole is not communicated with the through hole and positioned corresponding to the one of the plurality of pins; when the lower section housing is positioned within the through hole, the one of the plurality of pins extends into the pin hole.

20. The keyswitch structure of claim 19, wherein the shape of the through hole is substantially matching the horizontal cross-section of the lower section housing, so the lower section housing is fitted into the through hole and substantially contacts an inner wall of the through hole, but the midsection housing is unable to enter the through hole and abuts the top surface of the circuit board, and the horizontally-extended portion is positioned above the circuit board.

* * * * *